US006568949B1

(12) United States Patent
Walters

(10) Patent No.: US 6,568,949 B1
(45) Date of Patent: May 27, 2003

(54) QUICK ACCESS DEVICE FOR COUPLER

(75) Inventor: James Craig Walters, Fort Worth, TX (US)

(73) Assignee: Williams-Pyro, Inc.

( * ) Notice: Subject to any disclaimer, the term of this patent is extended or adjusted under 35 U.S.C. 154(b) by 0 days.

(21) Appl. No.: 09/910,972

(22) Filed: Jul. 20, 2001

Related U.S. Application Data

(60) Provisional application No. 60/249,151, filed on Nov. 16, 2000.

(51) Int. Cl.[7] ..... H01R 13/62
(52) U.S. Cl. ..... 439/319; 439/906
(58) Field of Search ..... 439/311, 314, 439/319, 607, 906, 660

(56) References Cited

U.S. PATENT DOCUMENTS 3,719,918 A * 3/1973 Kerr ..... 439/319
3,781,676 A 12/1973 Williams ..... 324/72.5
4,613,198 A * 9/1986 Selvin et al. ..... 439/906
4,904,200 A 2/1990 Williams ..... 439/349

* cited by examiner

*Primary Examiner*—Renee Luebke
*Assistant Examiner*—Ann McCamey
(74) *Attorney, Agent, or Firm*—Arthur F. Zobal

(57) ABSTRACT

The invention is directed to apparatus for making an accessible connection between a cable and a coupler, wherein electrical wires extend between the cable and the coupler. A removable stop is provided which is adapted to engage the cable and the coupler to hold the cable and the coupler apart to form a gap therebetween wherein the electrical wires extend between the cable and the coupler by way of the gap. A sleeve is provided which is movable between a closed position wherein the sleeve engages the cable and the coupler and surrounds the wires and the stop, and an open position wherein the gap is exposed and the wires are accessible. Also provided is a fastening mechanism for removably fastening the sleeve in the closed position and for allowing the sleeve to be moved from the closed position to the open position.

40 Claims, 13 Drawing Sheets

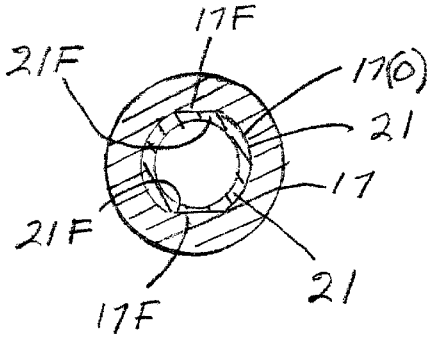
FIG. 7
FIG. 8
FIG. 9
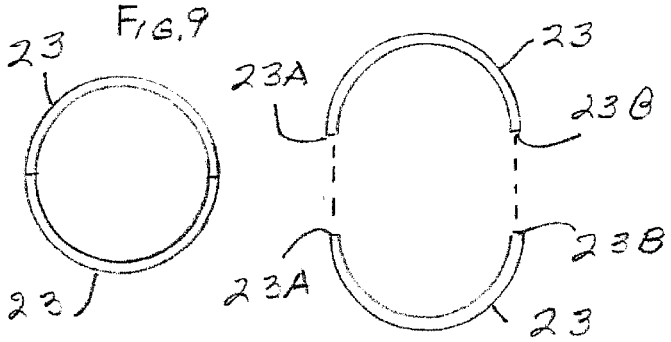
FIG 11
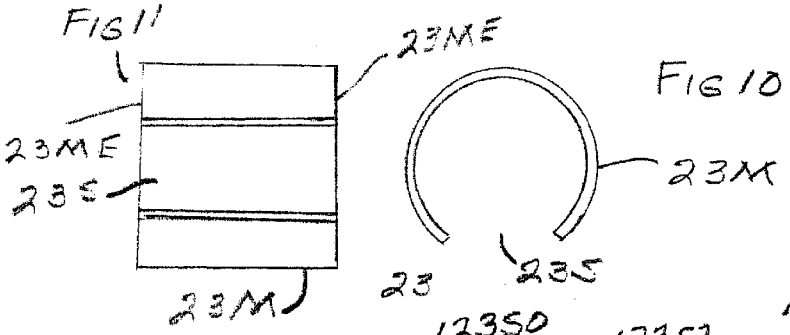
FIG 10
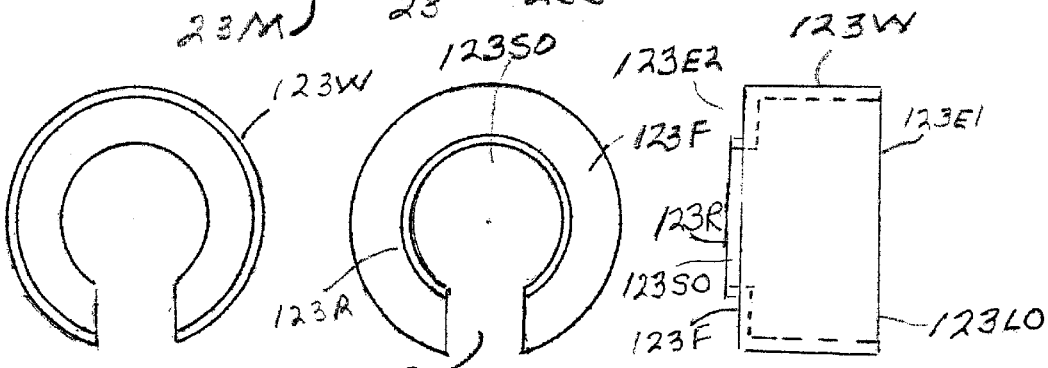
FIG 14 FIG 13 FIG 12

QUICK ACCESS DEVICE FOR COUPLER

This application claims the benefit of Provisional Application No. 60/249,151, filed Nov. 16, 2000.

BACKGROUND OF THE INVENTION

1. Field of the Invention

The present invention relates to devices for coupling cables to connectors and the like.

2. Description of the Prior Art

Connectors are used to removably couple electrical conductors to each other. Such connectors, which are used in electrical and electronic equipment, find particular application on military equipment (for example, aircraft).

When an aircraft is being serviced on the ground, ground personnel connect test equipment to the electrical and electronic systems on board the aircraft. For example, test equipment is connected to bomb racks to test circuit continuity and operability.

Cables are used to connect the test equipment to the on board equipment. These cables have a connector at each end. The entire assembly of cables and connectors is a cable assembly. A cable assembly may have only two ends, or it may have branches such as in a wye shape.

Repeated handling of the cable assemblies to connect and disconnect to and from the aircraft results in the cables becoming flexed. The wires inside of the cables are connected to the connectors by either by solder, crimped connections or other type of connection. Eventually, the connections can be broken due to the flexing of the cable.

Repair of existing cable assemblies is difficult because the connections are not easily accessible. The cable sheathing typically contacts the connector and the joint between the cable sheathing and the connector is overlaid with heat-shrink tubing. Repair of the connections involves destroying the heat-shrink tubing and somehow pulling the cable sheath away from the connector to expose the connections. This prior art repair procedure is time consuming and difficult.

SUMMARY OF THE INVENTION

It is the object of the present invention to provide quick access to cable connections.

The invention is directed to apparatus for making an accessible connection between a cable and a coupler, wherein electrical wires extend between the cable and the coupler. A removable stop is provided which is adapted to engage the cable and the coupler to hold the cable and the coupler apart to form a gap therebetween wherein the electrical wires extend between the cable and the coupler by way of the gap. A sleeve is provided which is movable between a closed position wherein the sleeve engages the cable and the coupler and surrounds the wires and the stop, and an open position wherein the gap is exposed and the wires are accessible. Also provided is a fastening means for removably fastening the sleeve in the closed position and for allowing the sleeve to be moved from the closed position to the open position.

In a further aspect, the sleeve is slidable on the cable such that the sleeve slides on the cable away from the coupler when moved to the open position and slides on the cable toward the coupler when moved to the closed position.

In the preferred embodiment, the fastening means comprises a pin coupled to the coupler, and a curved slot formed in a first end of the sleeve for receiving the pin and fastening the sleeve to the pin and hence to the coupler when the sleeve is rotated in a first direction to locate the pin in the slot at a holding position and for releasing the sleeve from the pin when said sleeve is rotated in a direction opposite the first direction.

In other embodiments, the fastening means comprises a first fastening member movably coupled to the coupler and a second fastening member formed on the first end of said sleeve such that the two fastening members can be fastened together when the sleeve is in the closed position and unfastened to allow the sleeve to be moved to the open position.

In a further aspect, the cable has a fitting coupled thereto. The sleeve has a second end opposite its first end and a first opening extending from the first end to the second end. The second end comprises an inward extending wall which defines a second opening which is smaller than the first opening. The cable extends through the second opening. The cable has a fitting coupled thereto with an outward extending portion located in the first opening and which cannot pass through the second opening. A spring is located between the inward extending wall of the sleeve and the outward extending portion of the fitting for applying a force to the sleeve away from the coupler when the stop engages the cable and the coupler and the sleeve is fastened in its closed position.

In one embodiment, the stop comprises two semi-cylindrical members for surrounding the wires. In another embodiment, the stop comprises a single hollow cylindrical member with a gap formed through its walls between its two ends for receiving the wires.

BRIEF DESCRIPTION OF THE DRAWINGS

FIG. 7 is a cross-section of FIG. 4B as seen along lines 7—7 thereof.

FIG. 8 illustrates the two collar members of FIG. 3.

FIG. 9 illustrates the two collar members of FIG. 8 with their edges engaging each other.

FIG. 10 is an end view of a modified collar.

FIG. 11 is a view of the collar of FIG. 10 as seen along its gap or slit.

FIGS. 12, 13, and 14 illustrates a collar similar to that of FIGS. 10 and 11 but with modifications. FIG. 12 is a side view of the modified collar. FIG. 13 is a view of the collar as seen from the left of the collar of FIG. 12. FIG. 14 is a view of the collar as seen from the right of the collar of FIG. 12.

DESCRIPTION OF THE PREFERRED EMBODIMENTS

Figure 1:
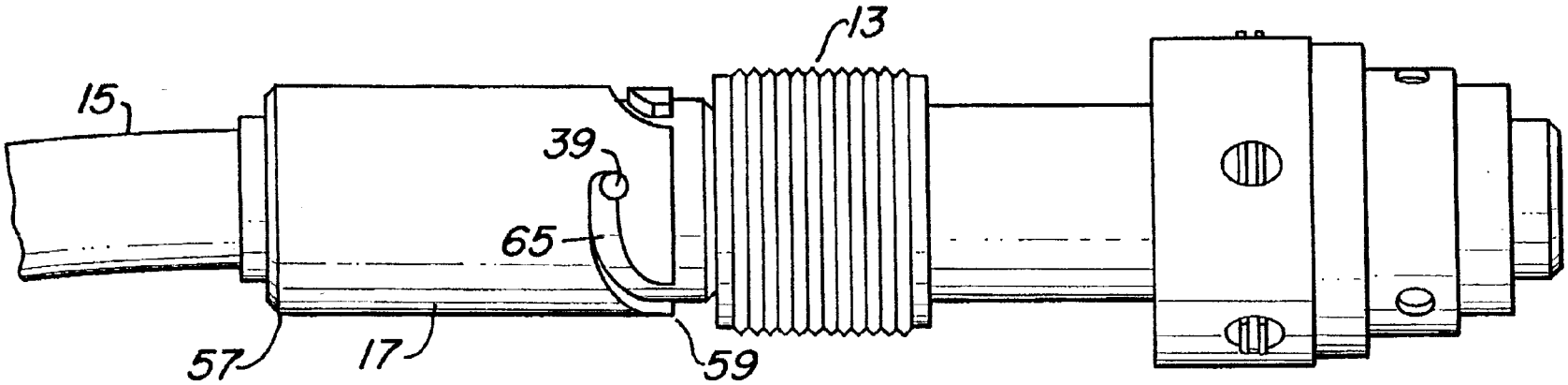
FIG. 1 is a plan view of a quick access device of the present invention, in accordance with a preferred embodiment, shown in conjunction with a test probe. The quick access device is shown in the closed and latched position.
Figure 2:
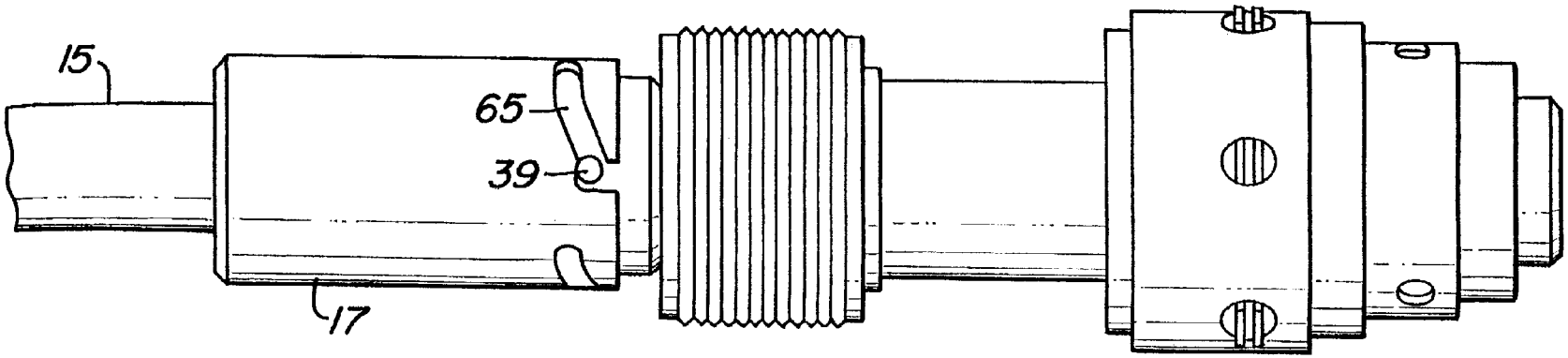
FIG. 2 is a plan view of the quick access device of FIG. 1 shown in a partially unlatched position.
Figure 3:
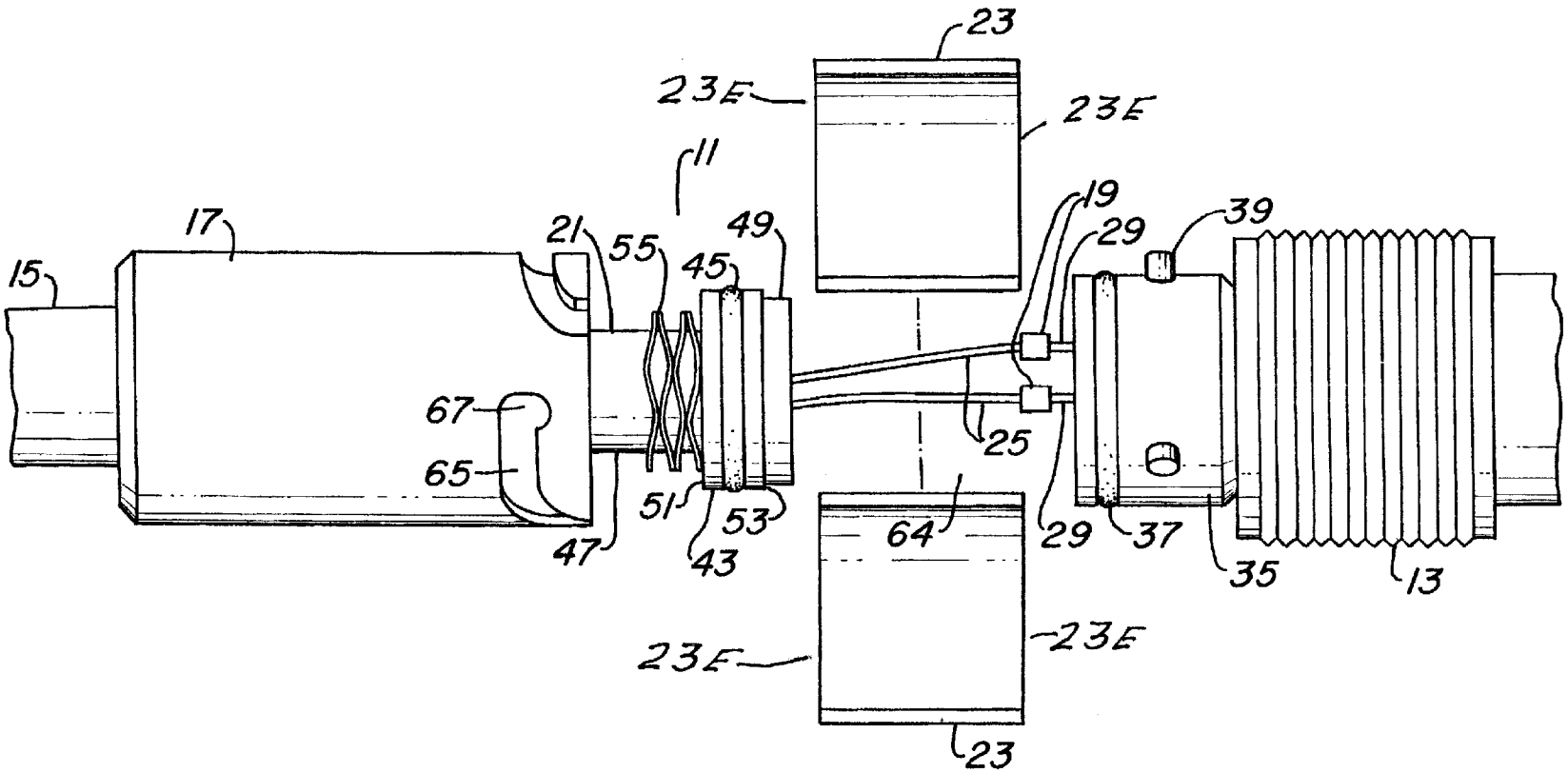
FIG. 3 is a plan view showing the open and disassembled quick access device.

FIGS. 1–3 show the quick access device 11 in accordance with a preferred embodiment, being used in conjunction with a test probe apparatus having a coupler or connector 13. Such a test probe apparatus is described in U.S. Pat. No. 4,904,200 the disclosure of which is incorporated herein by reference. The quick access device 11 can also be used with connectors, adapter breeches, and other coupler type devices that couple to cables 15.

The quick access device 11 has a sleeve 17 that slides along the cable 15. The sleeve 17 moves between a closed, latched position shown in FIG. 1, to a closed, unlatched position, shown in FIG. 2, to an open position shown in FIG. 3. In the closed latched position (FIG. 1), the wire connections 19 to the test probe are covered and sealed from the elements. In the open position (FIG. 3), the wire connections 19 are exposed for inspection and repair. The sleeve can be slid back to its closed position and rotated to latch it in place, in order to once again seal the wire connections 19.

Figures 4A, 4B:
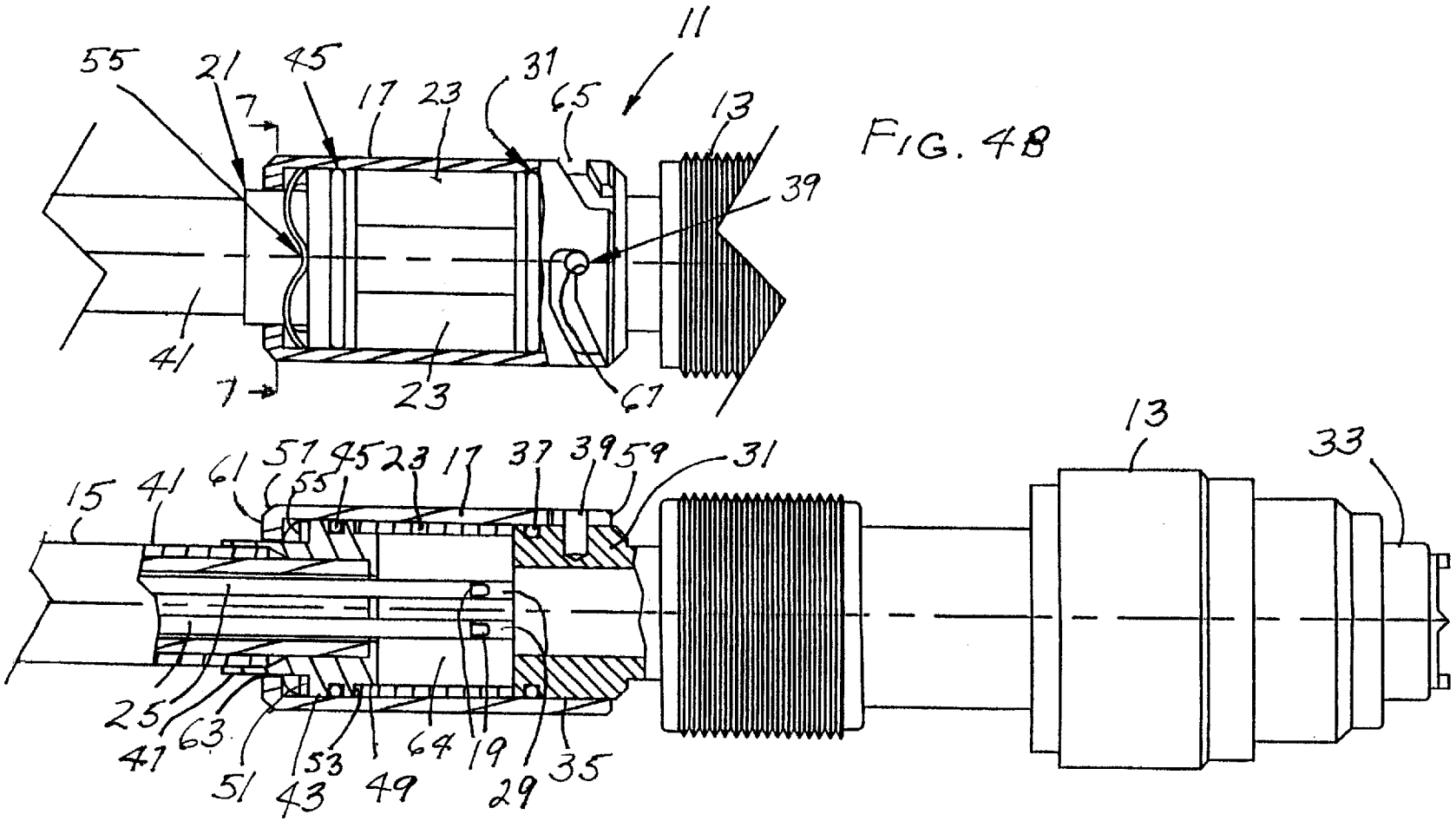
FIG. 4A is a longitudinal cross-sectional view of the quick access device.
FIG. 4B is a longitudinal cross-sectional view of the quick access device shown in a different orientation (rotated 90 degrees).

The quick access device 11 will now be described in more detail referring to FIGS. 4A and 4B. The quick access device 11 includes a coupler 13, a cable fitting 21, a split collar 23, and a sleeve 17.

The coupler 13 can be, as discussed above, a connector per se, or attached to or a part of a test probe, adapter breech, etc. The coupler has wires 25 extending from one end 31. The wires 25 are typically soldered to terminals 29 (see FIG. 4A) to form the wire connections 19. Alternatively, other types of connections can be used such as crimped connections. The other end 33 of the test probe 12 has electrical contacts to make continuity with an electrical circuit. The coupler shown in the Figs. is an in-line coupler. The coupler could be a 90 degree coupler such as is shown in U.S. Pat. No. 4,904,200. At the end 31 with the wire connections 19, the coupler 13 has a cylindrical surface 35. The cylindrical surface 35 has a circumferential groove therein, which groove receives an O-ring 37. The O-ring 37 is interposed between the wire connections 19 and plural pins 39. The pins 39 extend radially from the cylindrical surface 35 and serve to retain the sleeve 17 in a closed and latched position.

The cable 15 has a sheath 41 that forms a protective covering over the wires 25. The cable 15 may include spare wires to allow for easier repair.

The cable fitting 21 is fixedly coupled to one end of the cable sheath 41 such that it cannot rotate relative to the sheath 41. The cable fitting 21 is a ring, wherein the wires 25 pass through the center of the fitting. The fitting 21 has an enlarged portion comprising an intermediate cylindrical surface 43, which surface has a circumferential groove for receiving an O-ring 45. The intermediate cylindrical surface 43 is located in the intermediate portion of the fitting 21. Extending in both directions from the intermediate cylindrical surface 43 are cylindrical surfaces 47, 49, having reduced diameters relative to the intermediate cylindrical surface 43. Stop surfaces 51, 53 are formed between each of the reduced diameter cylindrical surfaces 47, 49 and the intermediate cylindrical surfaces 43. The stop surface 51 facing the cable 15 receives a spring 55. The stop surface 53 facing the coupler 13 receives an end of the split collar 23.

The split collar 23 has an outside diameter that is substantially the same as the cylindrical surfaces 35, 43, that bear against the O-rings 37, 45. The wires 25 pass through the inside of the split collar 23.

The sleeve 17 is a cylindrical tube having two ends 57, 59. One end 57 has a radially inward lip 61. The lip 61 has an opening 63, the diameter of which is less than the diameter of the intermediate cylindrical surface 43. The inside diameter of the remainder of the sleeves 17 is slightly larger than the outside diameter of the cylindrical surfaces 35, 43. When the sleeve 17 is in its closed position, the O-rings 37, 45, form circumferential seals around the inside of the sleeve 17. The other end 59 of the sleeve has slots 65 for receiving and locking the pins 39, which together act as a latch or fastener.

In operation, when the sleeve 17 is in its closed and locked position, the cable fitting 21 is actually separated from the coupler 13 by the split collar 23. The split collar 23 forms a standoff or stop that prevents the cable fitting 21 from moving closer to the coupler 13. Thus, the split collar 23 maintains a gap 64 between the fitting 21 and the coupler 13. The sleeve 17, with its lip 61 and slots 65, prevents the fitting 21 from actually separating from the coupler 13. As will be described subsequently, the sleeve also prevents rotational movement between the fitting 21 and the coupler 13. Thus the cable sheath 41 is firmly secured at the coupler 13. The pins 39 are in detents 67 in the slots 65. Thus, the sleeve 17 is unable to rotate so as to free the pins 39 of the slots 65. Likewise, the spring 55 exerts a bias force on the sleeve 17 away from the coupler 13 as to maintain the pins 39 in the detents 67. The wire connections 19 are sealed by the sleeve 17, the O-rings 37, 45, the cable sheath 41 and the coupler 13. The sleeve 17 completely covers the gap 64 between the fitting 21 and the coupler 13.

Frequent use of the cable assembly 71 typically causes the cable 15 to be flexed. From time to time, a wire connection 19 may break, requiring repair. Alternatively, a wire 25 may break necessitating the use and connection of a spare wire in the cable to a terminal 29. To access the connections 19, the sleeve 17 is pushed towards the coupler 13 to overcome the resistance of the spring 55 and to clear the pins 39 of the detents 67. The sleeve 17 is then rotated to free the pins 39 of the slots 65 (FIG. 2) and the sleeve 17 is then pulled back away from the coupler 13 to an open position to expose the split collar 23. The split collar 23 is removed to expose the wire connections for repair. The quick access device is assembled in the reverse order.

In the preferred embodiment, the split collar 23 need only bear on the end of the coupler 13. That is to say, the split collar 23 need not bear on a cylindrical surface of reduced diameter at the coupler 13. The cylindrical surface 49 provides a satisfactory radial stop for supporting the split collar 23. This eliminates the need to form a cylindrical surface of reduced diameter on the coupler 13, which adds to the cost of milling the part. It also simplifies the assembly because the coupler 13 need not be inserted into the split collar 23. However, such a provision can be made if desired.

Equipping both ends of a cable 15 with a quick access device 11 allows the cable sheath 41 to be slide along the wires 25. This increases the gap 64 to access the wire connections 19. For example, if the wire connections at one end are to be repaired, this gap can be widened by moving the respectively sleeves out of the way from both ends and sliding the cable sheath away.

Figure 5:
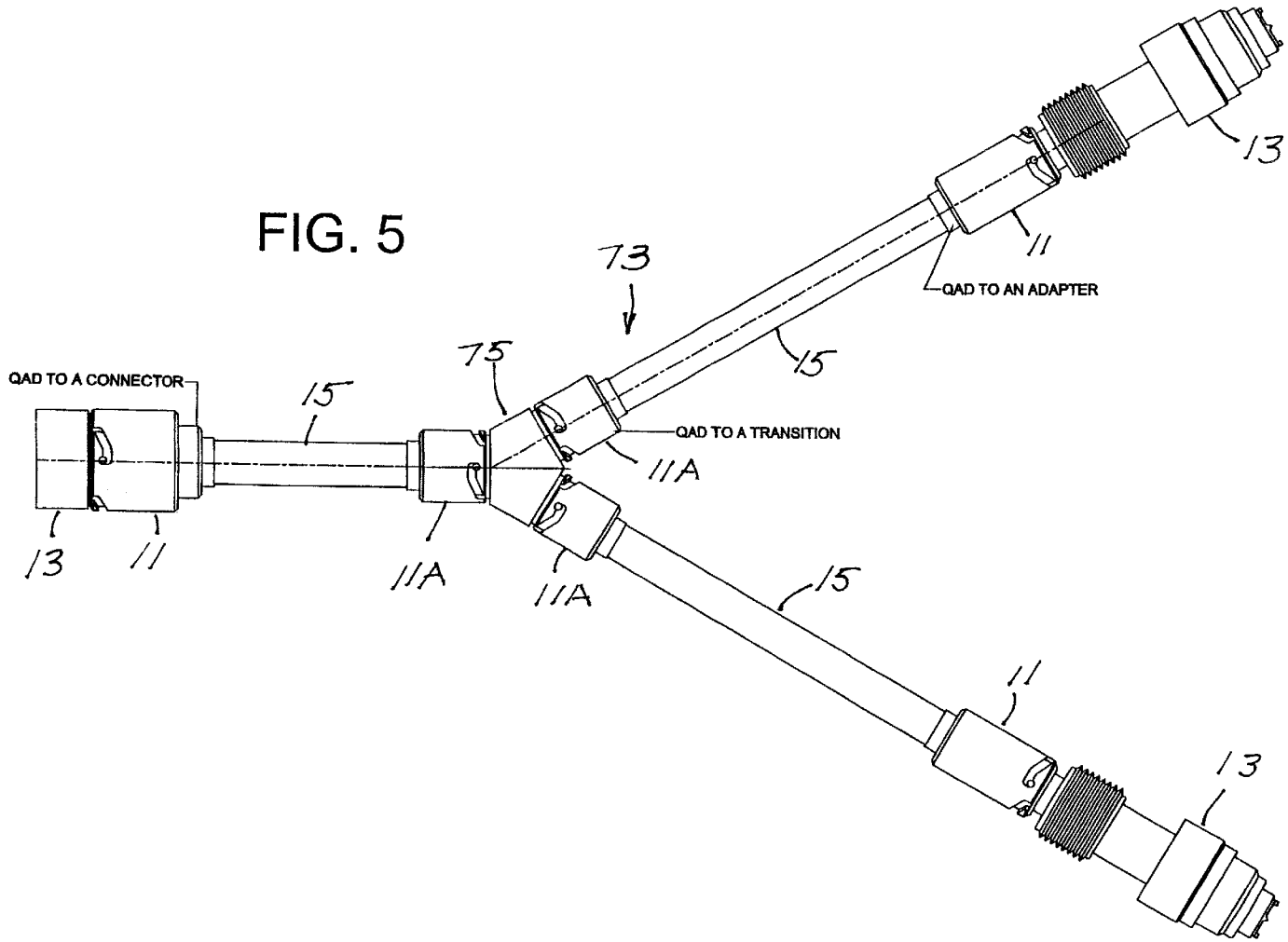
FIG. 5 shows quick access devices of the present invention used on a wye cable.
Figure 6:
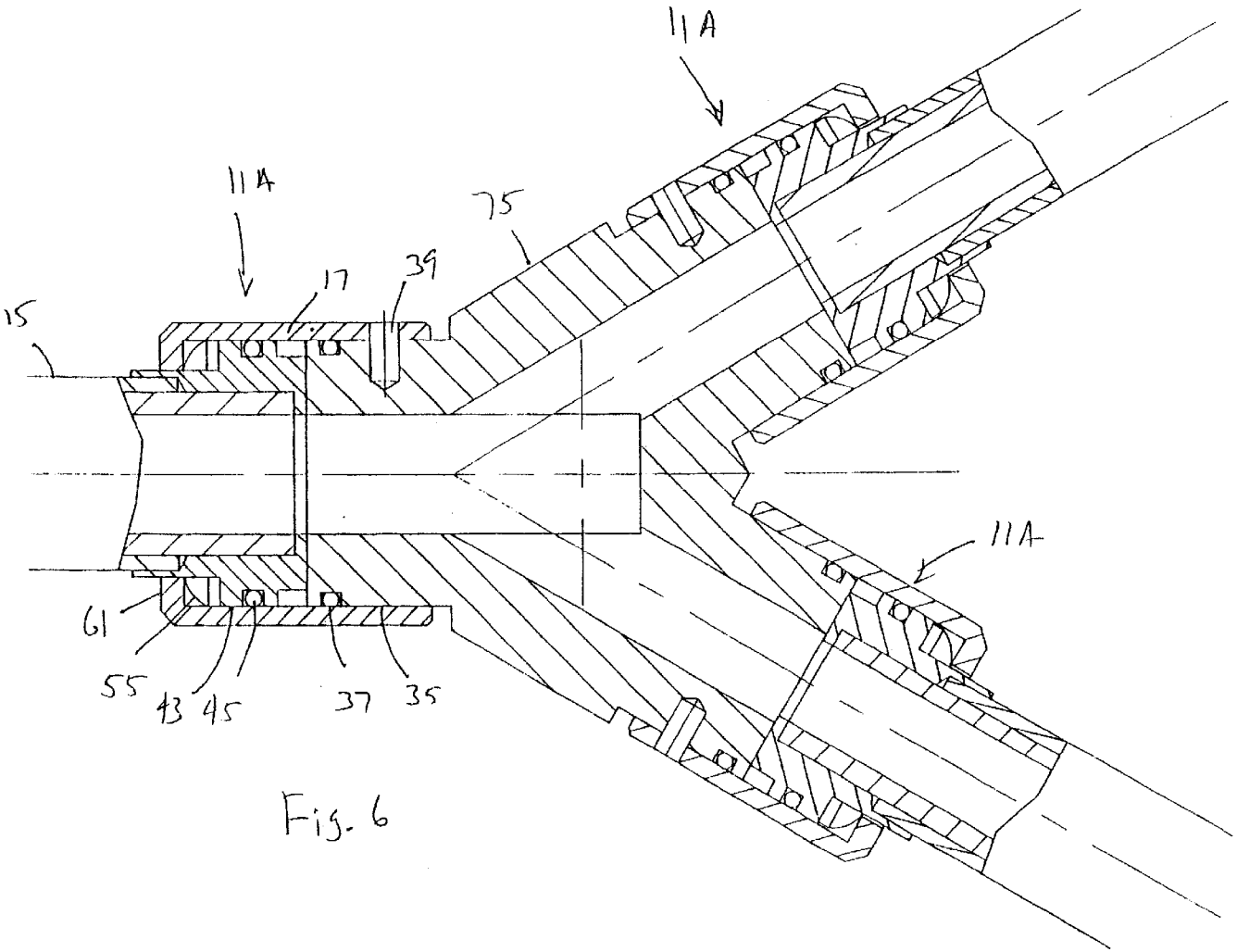
FIG. 6 is a close up cross-sectional view of a wye connection equipped with a number of the quick access devices, in accordance with another embodiment.
Figure 15:
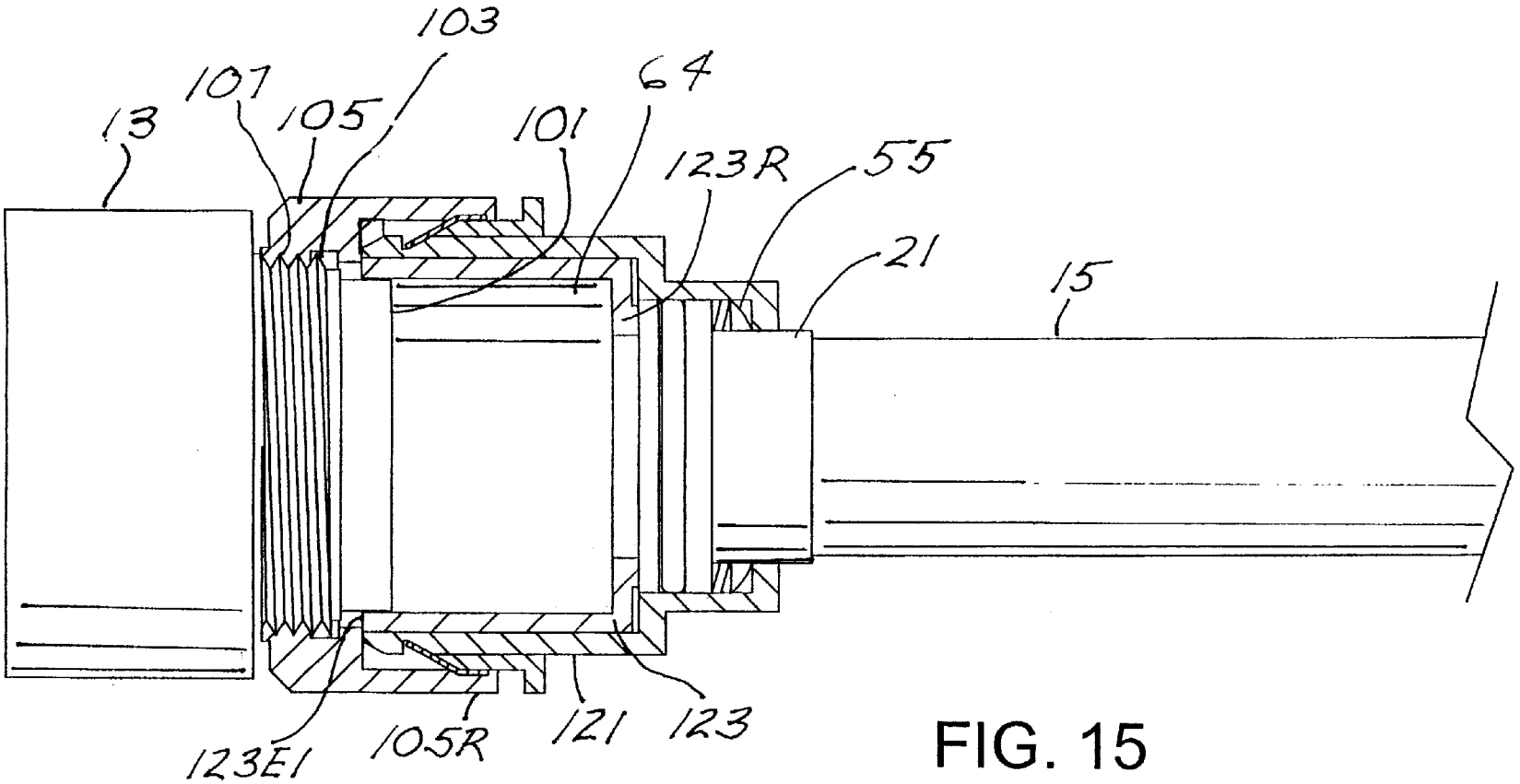
FIGS. 15 and 16 illustrate a modified connection and release mechanism for a quick access device.
Figure 16:
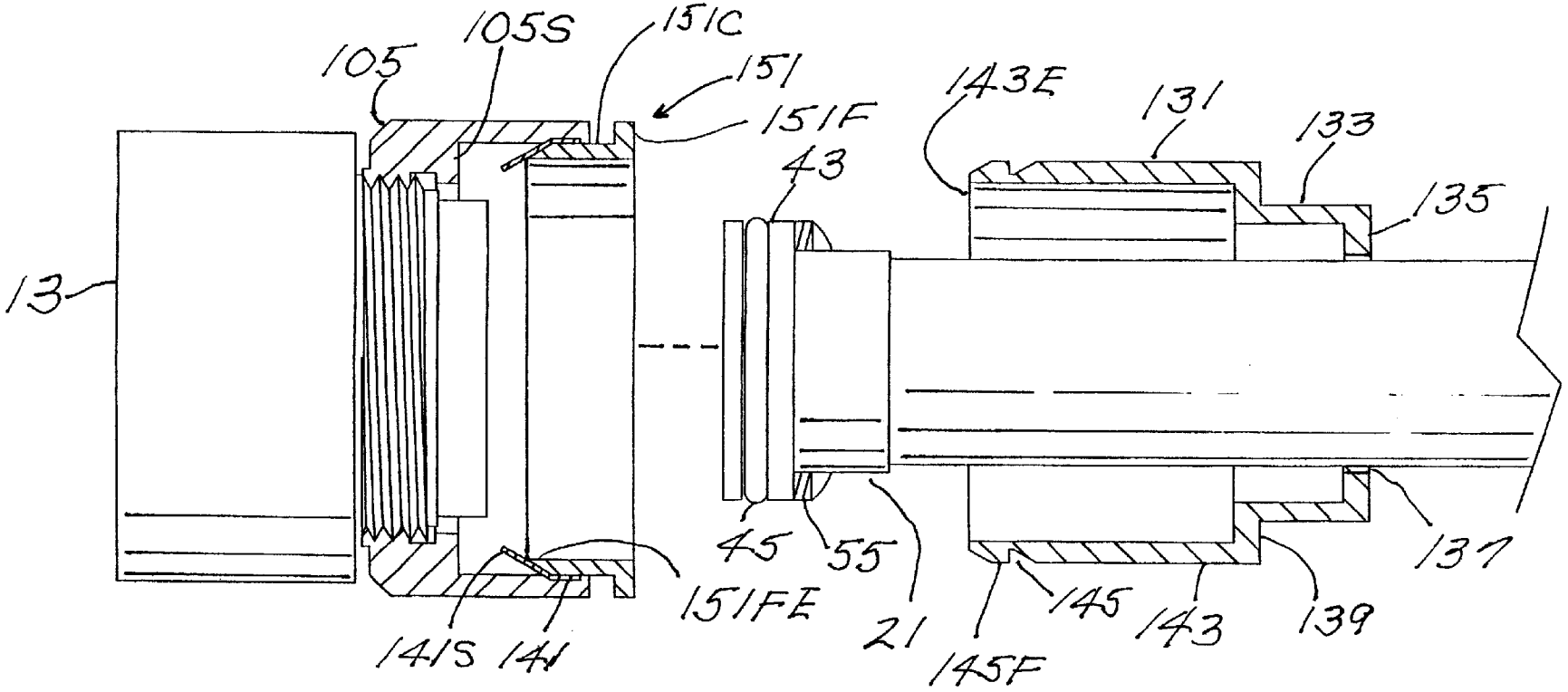

In FIGS. 5 and 6 a wye cable assembly 73 is shown. There are multiple cables, with each end of the cables having a coupler 13 and a quick access device 11, in accordance with the invention , associated with each coupler. In addition, the wye junction is provided with a 3 port coupler 75. This coupler has a quick access device 11A at each port. Because the coupler 75 typically has only wires extending therethrough and no soldered connections, a gap need not be provided in the quick access device. Thus, the split collars members 23 or collar member 23M of FIGS. 10 and 11 need not be provided. The gap between the cable fitting 21 and the coupler 75 is zero wherein the parts butt against each other.

Referring to FIG. 7, the rear opening 63 of the sleeve 17 has two flat side portions 17(F) which mate with two flat edges respectively 21F of the fitting 21 which prevent the sleeve 17 from rotating relative to the fitting 21 and hence the cable 15. Thus with the pins 39 held in the detents 67 of the slots 65 by force of the spring 55, the fitting 21 (and hence the cable 15) and the coupler 13 cannot rotate relative to each other in normal operations. The sleeve 17 can be released from the pins 39 as described previously to move the sleeve 17 to an open position.

Referring to FIGS. 3, 8, and 9, the split collar 23 comprises two half cylindrical members having edges 23A and 23B which engage each other when located in the sleeve 21 with their ends 23E engaging the stop surface 53 and the end of the coupler 13.

Referring to the FIGS. 10 and 11, the collar may be a single hollow cylindrical member 23M having a slit or gap 23S formed through its wall between its ends 23ME. The slit 23S will be wide enough to receive the wires and the wire connections.

Referring now to FIGS. 12–16, there will be described another embodiment of the invention for coupling a cable 15 to a coupler or connector 13. The connector 13 has an end member 101 with threads 103. The cable 15 has the fitting 21 fixedly coupled thereto with a larger diameter portion 43. A slot is formed in the cylindrical surface 43 of the fitting 21 with an annular groove in which is located a resilient O-ring 45. Also provided is a spring 55 which bears against the rear end of the enlarged portion 43 of the fitting 21. Although not shown, wires will extend from the cable 15 and fitting 21 and from the end 101 of the connector 13 which will be connected together in the gap or space 64 between members 21 and 13. The gap 64 is formed by a connector adapter 105 which has threads 107 which are screwed to threads 103 of the coupler 13; a sleeve 131 and a collar 123. Preferably the collar is of the type shown in FIGS. 12–14. It comprises a hollow cylindrical wall 123W with a slit or gap 123S formed therethrough between its ends 123E1 and 123E2. End 123E1 is a single edge which defines a larger and diameter opening 123LO and end 123E2 comprises a flat wall 123F perpendicular to wall 123W with a smaller diameter opening 123SO. A ridge 123R extends from the wall 123F around the opening 123SO. The slit 123S extends through the wall 123S and ridge 123R. The adapter 105 has a shoulder 105S. The collar end 123E1 bears against the shoulder 103S and the ridge 123R bears against the forward end of the cable fitting 21 to hold the cable fitting 21 and coupler 13 apart to form the gap or space 64.

A coupling nut or member 131 and a latch 141 are provided for securing the cable 15, and adapter 21 to the coupler 13 held apart by the collar 123. The member 131 comprises a smaller diameter cylindrical portion 133 having an inward extending end portion 135 with an opening 137 for receiving the adapter 21; an outward extending portion 139 coupled to a larger diameter cylindrical portion 143 which serves as a sleeve and surrounds the collar 123 when in the closed position of FIG. 15. An annular notch 145 is formed in the exterior of the cylindrical portion 143 near its end 143E. Spring latches 141S extend in the slot 145 to hold the nut 131 and sleeve 121 in place for holding the fitting 121 and coupler 13 together. The latch 141, 141S and the slot 145 act as a latch or fastener.

The latch 141 comprises a ring having a plurality of spaced apart spring members 141S, secured to the inside of the adapter 105, at its rear edge 105R with the ends of the members 141S extending inward in a forward direction. A release device 151 is provided which comprises a cylindrical wall 151C with an outward extending flange 151F at its rear end. The front end 151FE of the wall 151C tapers inward.

In order to close the apparatus, the removable collar 123 is installed in the front end 143E and the coupling nut is pushed into the rear end of the adapter 105 until the ends 141S of the spring latch 141 latch into the slot 145 where they engage the edge 145F of the slot and couple and hold the adapter 105 and nut 131 together.

In order to open the apparatus, the release device 151 and the coupling nut 131 are pushed toward the connector 13. The release device 151 is held in the forward position to move and hold the spring ends 141S out of the slot 145 to allow the coupling nut 131 to be moved away from the connector 13 to expose the removable collar 123 and allow it to be removed to gain access to the wires.

Figure 17:
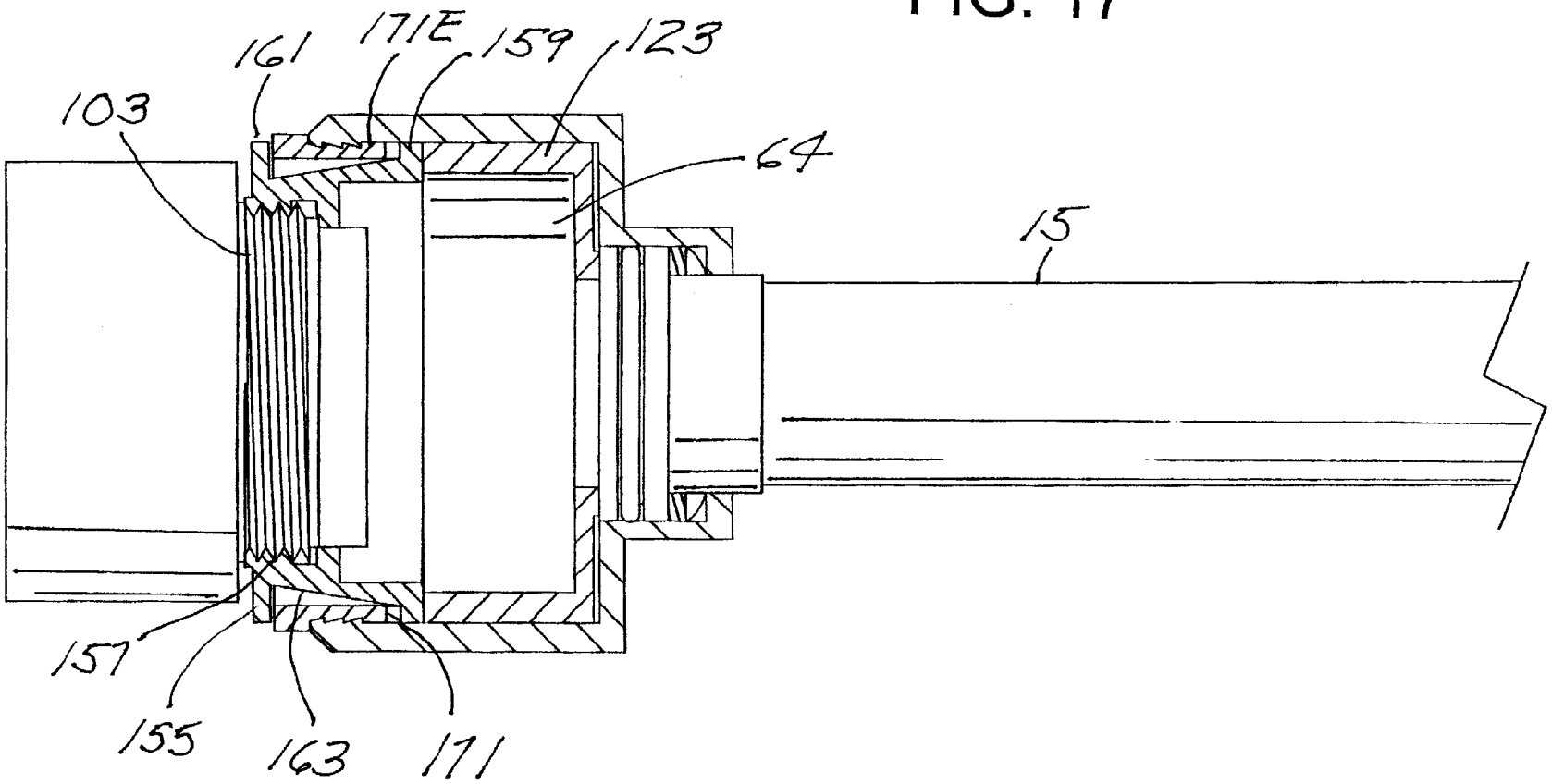
FIGS. 17 and 18 illustrate another modified connection and release mechanism for a quick access device.
Figure 18:
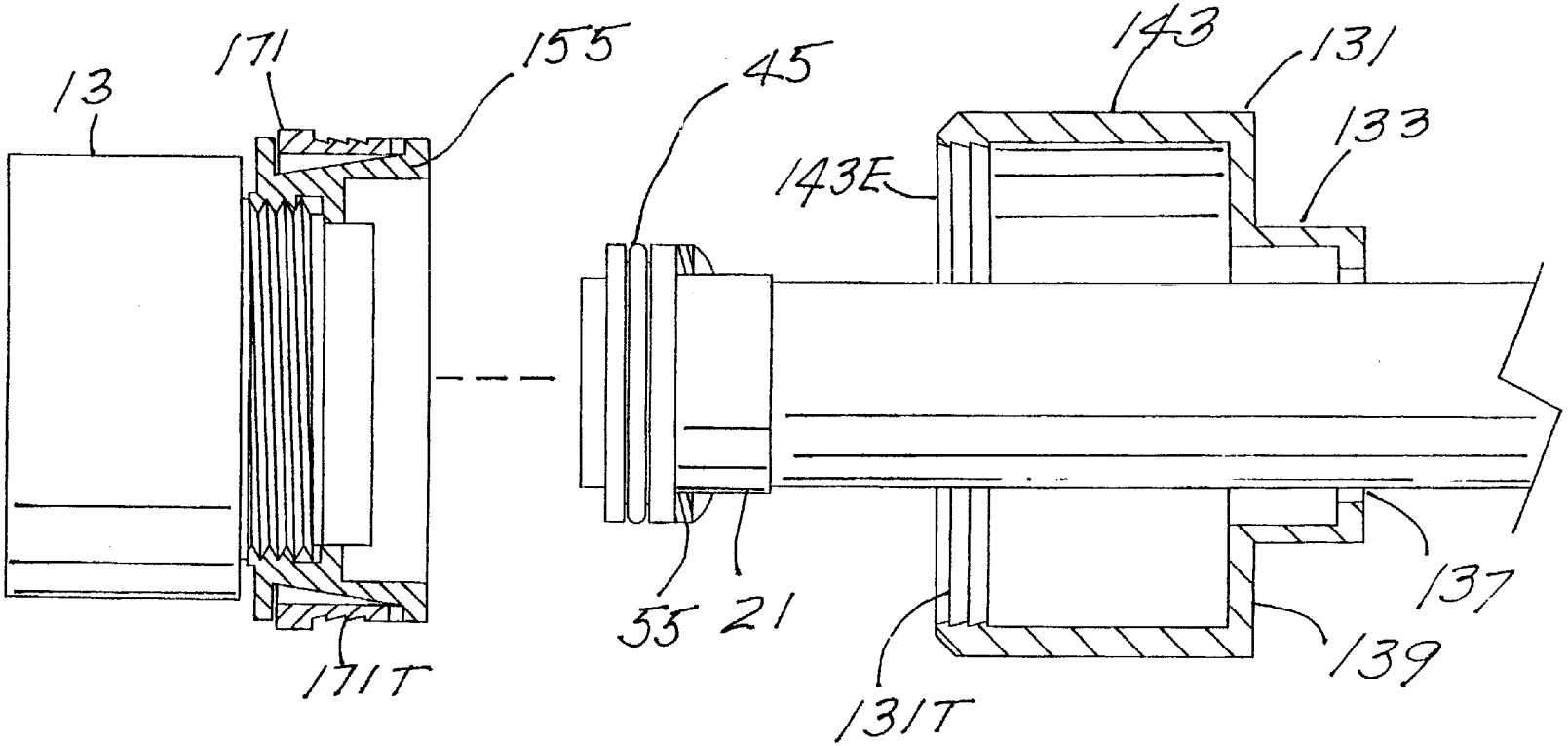

Referring to FIGS. 17 and 18 there will be described still another embodiment of the invention. The cable 15, fitting 21, spring 55, removable collar 123 and connector 13 are the same a those disclosed in FIGS. 12–16. The connector adapter, the latching or fastening mechanism, and the retaining nut have been modified. The adapter 155 comprises a ring shaped member having interior threads 157 which screw onto the threads 103 of the coupler 13. The outside of the adapter 155 comprises annular shoulders 159 and 161 and a cone shaped surface 163 which tapers down from shoulder 159 to shoulder 161. A retaining ring 171 is provided with a plurality of spring ears 171E which are normally biased outward as shown in FIG. 18. The ears 171E have teeth 171T. The retaining nut 131 is the same as that of FIGS. 15 and 16 except that it does not have the slot 145 but annular teeth 131T on its inside at the end 143E. The slant of the teeth 171T and 131T extend in opposite directions such that they can grip each other as shown in FIG. 17.

In order to close the unit, the coupling nut 131 is pushed toward the connector 13. The teeth 131T will slide around the teeth 171T of the ears 171E pushing the ears 171E down causing the teeth 131T and 171T to be locked together thus coupling the nut 132 to the adapter 155 and hence to the connector 13.

In order to open the unit, the ears 171E of the retaining ring 171 are depressed separating the teeth 171T and 131T allowing the coupling nut 131 to be pulled away from the connector. This will expose the removable collar 123 and allowing it to be removed allowing access to the wires. The retaining ring 171, ears 171E and the teeth 131T act as a latch or fastener.

Figure 19:
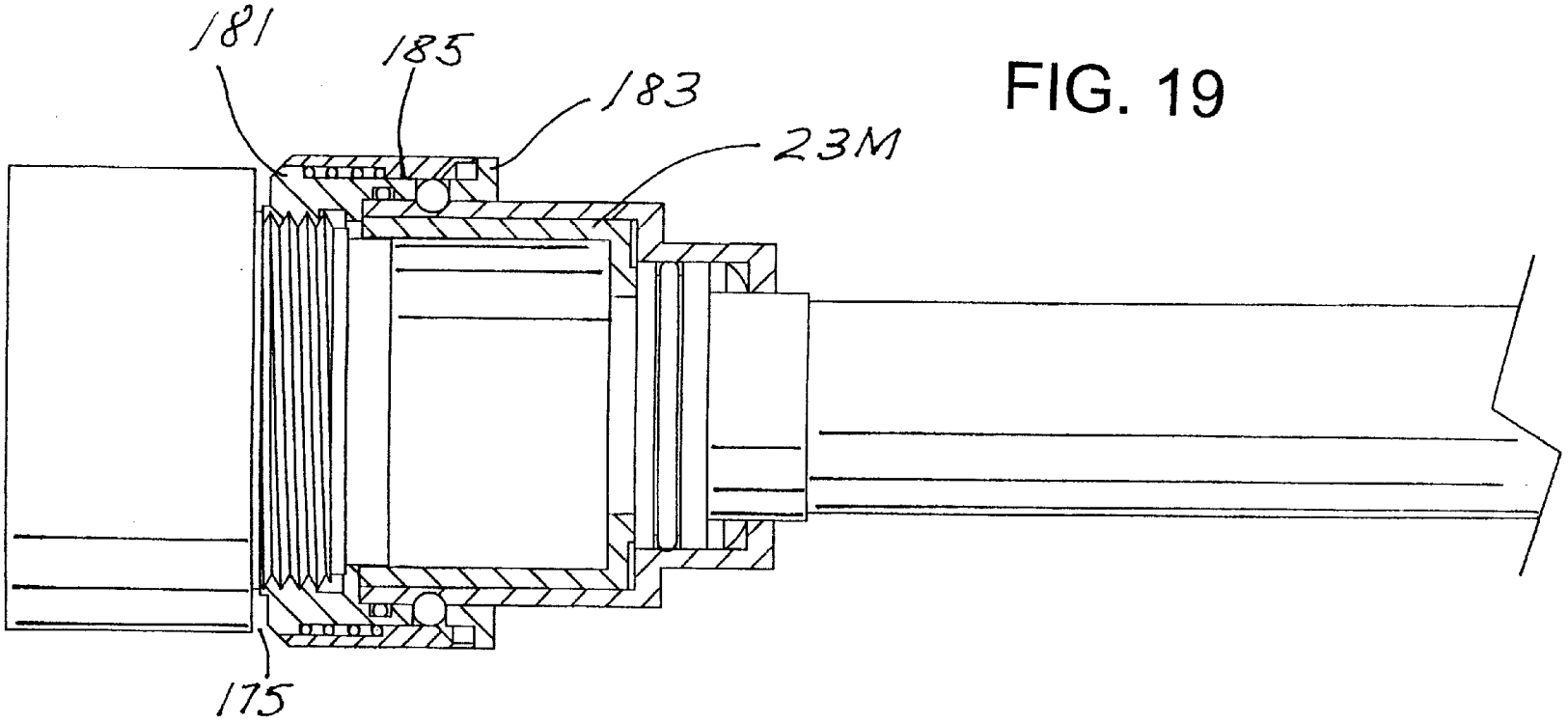
FIGS. 19 and 20 illustrate still another modified connection and release mechanism for a quick access device.
Figure 20:
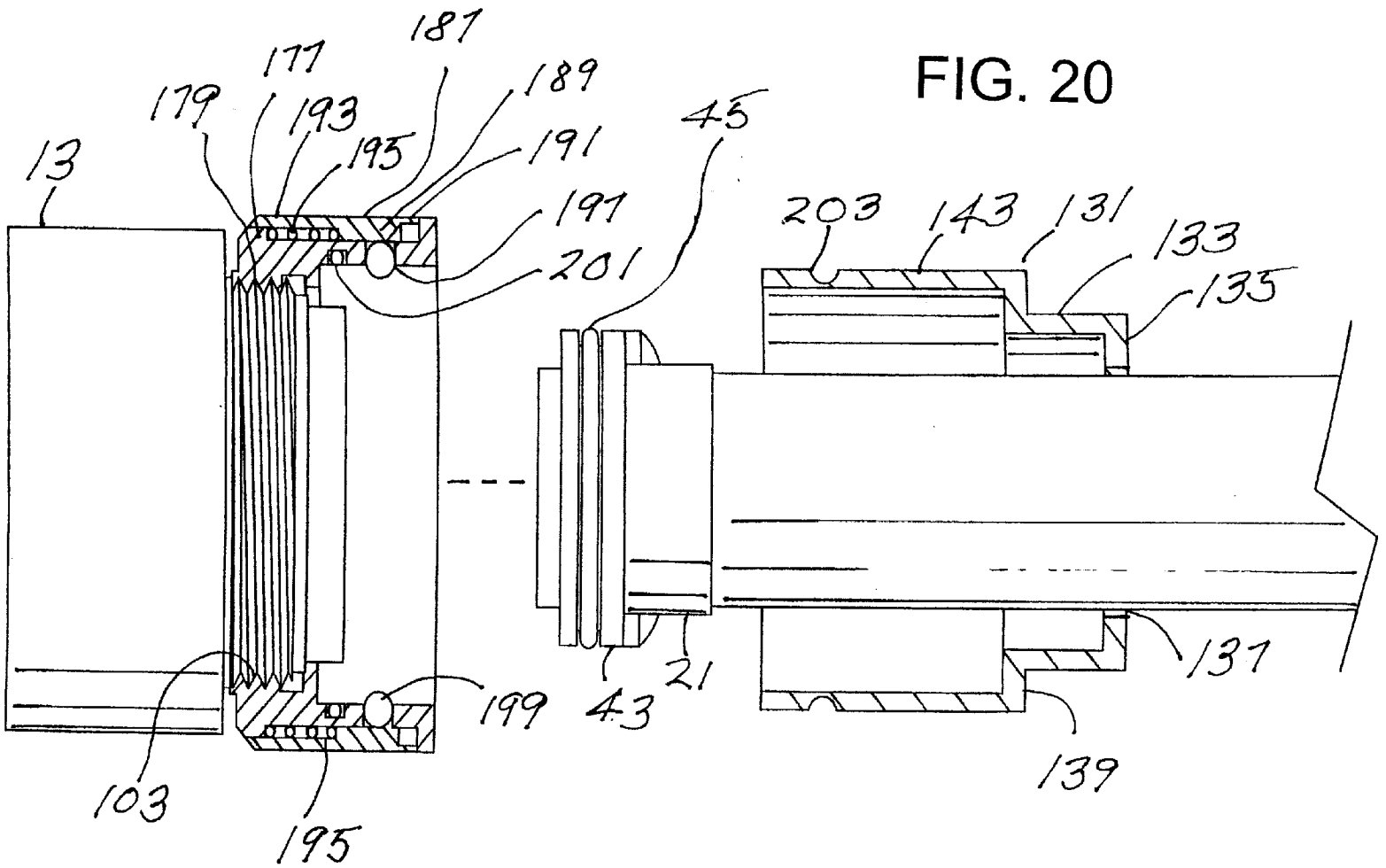

Referring to FIGS. 19 and 20 there will be described another embodiment of the invention. The cable 15, the fitting 21, spring 55, removable collar 123 and connector 13 are the same as those disclosed in FIGS. 12–18. The connector adapter, the latching mechanism, and the retaining nut have been modified. The adapter 175 comprises an annular member 177 having interior threads 179 which screw onto the threads 103 of the coupler 13. The annular member 177 has two ring shaped rims 181 and 183 which extend outward from an annular surface 185. A slidable annular cover 187, having an annular main base 189 and thinner annular walls 191 and 193 extending from opposite ends of the base 189, is provided. A spring 195 is located inside of the wall 193 and bears against rim 181 of the adapter 175 and the cover 187. The annular member 177 has four angularly spaced apart apertures 197 formed therethrough for receiving four balls 199. Member 201 is an elastomer O-ring. The retaining nut 131 has an annular slot 203 formed in the exterior of its wall 143.

The diameters of the apertures 197 and balls 199 are such that the balls 199 are contained by the smaller diameters of the apertures 197 and by the cover 187 when the sleeve 131 is in its open position as shown in FIG. 20. To latch the sleeve 131 to the adapter in its closed position, the cover 187 is pulled to the left (as seen in FIGS. 19 and 20) away from the apertures 197 to place the thin wall 191 over the balls 197 and the sleeve 131 is inserted inside the adapter 177. The balls 199 will be pushed outward a small amount under the wall 191 to allow the slot 203 to be in line with the balls such that the balls 199 will move into the slot 203 and the cover 178 will be released such that the spring 195 will move the cover 187 to the right (as seen in FIGS. 19 and 20) and hold the balls 197 in the slot 203 to latch or fasten the sleeve to the adapter 175. The stop 23M also will be located in place as shown in FIG. 19 to cover the wires 25 which are not shown in FIGS. 19 and 20.

In order to move sleeve 131 out of the adapter to its open position, the cover 187 is pulled to the left (as seen in FIGS. 19 and 20) to locate the cover wall 191 over the balls 199 whereby they may move outward a short distance, and the sleeve 131 is pulled outward pushing the balls radially outward out of the slot 203 and then removed from the adapter. The cover 187 then is released.

Although not shown in FIGS. 15–20, the wires 25, 29 and their connectors 19 will extend from the cable 15 and coupler 13 as shown in FIG. 3.

The foregoing disclosure and the showings made of the drawings are merely illustrative of the principals of this invention and are not to be interpreted in a limiting sense.

What is claimed is:

1. A connection apparatus, comprising:

a cable and a coupler;

said cable having an end with a cylindrical surface with a seal and a stop surface;

said coupler having a cylindrical surface with a seal and a pin, there being a gap between said cable and said coupler when coupled together with electrical conductors extending between said cable and said coupler by way of said gap;

a removable stop adapted to engage said coupler and said end of said cable to hold said cable and said coupler apart to form said gap;

a sleeve having a slot at one end for receiving said pin, and a lip at an opposite end for cooperating with said stop surface, said sleeve being movable between a closed position around said removable stop, wherein said cable seal and said coupler seal form seals with said sleeve and said lip engages said stop surface such that said sleeve prevents said cable and said coupler from pulling apart, and an open position, to allow said removable stop to be removed to provide access to said electrical conductors between said cable and said coupler.

2. A connection apparatus, comprising a cable and a coupler with wires extending between said cable and said coupler;

a gap located between said cable and said coupler;

a removable standoff located between said coupler and said cable so as to span said gap and to hold said cable and said coupler apart;

seals on said cable and said coupler;

a sleeve covering said gap and cooperating with said seals, said sleeve being coupled to said cable and to said coupler in a closed position and extending around said standoff and said wires;

said standoff being separate from said sleeve; and said sleeve being movable on said cable away from said coupler to an open position to allow said standoff to be removed to provide access to said wires.

3. The apparatus of claim 2 wherein said standoff comprises two members each of which is semi-cylindrical.

4. The apparatus of claim 2 wherein said standoff is provided with a radial stop so as to limit radially inward movement of said standoff.

5. The apparatus of claim 2 further comprising:

fastening means for removably fastening said sleeve to said coupler when said standoff is located between said coupler and said cable and a spring located between said cable and said sleeve to help hold said sleeve in a said closed position around said gap.

6. The apparatus of claim 2, wherein said standoff comprises a single hollow cylindrical member having two opposite ends with a gap extending between said two opposite ends.

7. A connection apparatus, comprising:

a cable member and a coupler member wherein electrical wires extend from said cable member and are connected by wire connections to electrical wires extending from said coupler member;

removable wall means defining a cavity for receiving said wires and said wire connections;

said wall means has opposite ends with one of said ends being adapted to engage said cable member and the other of said ends being adapted to engage said coupler member for holding said cable and said coupler members apart with said wires and said wire connections located in said cavity of said wall means;

a sleeve to be located around said wall means and releasably coupled to said cable member and to said coupler member with said wall means including said opposite ends located within said sleeve and to be uncoupled from one of said members and moved away from said one member to allow said wall means to be removed to provide access to said wires and said wire connections.

8. The apparatus of claim 7, wherein:

said wall means comprises two wall members each of which have two spaced apart edges with said two edges of one of said wall members being adapted to engage said two edges of the other of said wall member respectively to form an enclosed space for receiving said wires and said connections.

9. The apparatus of claim 7, comprising:

fastening means for removably fastening said sleeve to said cable and to said coupler member and for allowing said sleeve to be moved away from said coupler member while located around said cable.

10. The apparatus of claim 8, comprising:

fastening means for removably fastening said sleeve to said cable and to said coupler member and for allowing said sleeve to be moved away from said coupler member while located around said cable.

11. The apparatus of claim 7, wherein:

said wall means comprises a single member in the form of a hollow cylinder with a gap formed through said member which extends between said opposite ends.

12. The apparatus of claim 11, comprising:

fastening means for removably fastening said sleeve to said cable and to said coupler member and for allowing said sleeve to be moved away from said coupler member while located around said cable.

13. A connection apparatus, comprising:

a cable and a coupler, wherein electrical wires extend between said cable and said coupler;

a removable stop having opposite ends adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve extends beyond said opposite ends of said removable stop and engages said cable and said coupler and surrounds said wires and said removable stop, and an open position to allow said removable stop to be removed to provide access to said wires; and fastening means for removably fastening said sleeve in said closed position and for allowing said sleeve to be moved from said closed position to said open position.

14. The apparatus of claim 13, wherein:

said sleeve has a first end which engages said coupler when said sleeve is located in said closed position;

said fastening means comprises;

a pin coupled to said coupler; and a curved slot formed in said first end of said sleeve for receiving said pin and fastening said sleeve to said pin and hence to said coupler when said sleeve is rotated in a first direction to locate said pin in said slot at a holding position and for releasing said sleeve from said pin when said sleeve is rotated in a direction opposite said first direction.

15. The apparatus of claim 14, wherein:

said sleeve is slidable on said cable such that said sleeve slides on said cable away from said coupler when moved to said open position and slides on said cable toward said coupler when moved to said closed position.

16. The apparatus of claim 15, wherein:

said coupler has a stop surface;

said cable has an end with a stop surface;

said removable stop comprises two wall members each having first and second ends for engaging said stop surface of said coupler and said stop surface of said end of said cable respectively for holding said cable and said coupler apart;

each of said wall members having two spaced apart edges with said two edges of one of said wall members being adapted to engage said two edges of the other of said wall member respectively to form an enclosed space for receiving said wires.

17. The apparatus of claim 15, wherein:

said coupler has a stop surface;

said cable has an end with a stop surface;

said stop comprises a single member having first and second ends for engaging said stop surface of said coupler and said stop surface of said end of said cable respectively for holding said cable and said coupler apart;

said member comprises an enclosing wall with a gap formed through said enclosing wall between said first and second ends defining a cavity for receiving said wires.

18. The apparatus of claim 13, wherein said fastening means comprises:

a first fastening means movably coupled to said coupler and a second fastening means formed on said first end of said sleeve such that said first fastening means can be fastened to and unfastened from said second fastening means when said sleeve is at said closed position.

19. The apparatus of claim 18, wherein:

said sleeve is slidable on said cable such that said sleeve slides on said cable away from said coupler when moved to said open position and slides on said cable toward said coupler when moved to said closed position.

20. The apparatus of claim 19, wherein:

said coupler has a stop surface;

said cable has an end with a stop surface, said removable stop comprises two wall members each having first and second ends for engaging said stop surface of said coupler and said stop surface of said end of said cable respectively for holding said cable and said coupler apart;

each of said wall members having two spaced apart edges with said two edges of one of said wall members being adapted to engage said two edges of the other of said wall member respectively to form an enclosed space for receiving said wires.

21. The apparatus of claim 19, wherein:

said coupler has a stop surface;

said cable has an end with a stop surface;

said removable stop comprises a single member having first and second ends for engaging said stop surface of said coupler and said stop surface of said end of said cable respectively for holding said cable and said coupler apart;

said member comprises an enclosing wall with a gap formed through said enclosing wall between said first and second ends defining a cavity for receiving said wires.

22. The apparatus of claim 13, wherein:

said sleeve is slidable on said cable such that said sleeve slides on said cable away from said coupler when moved to said open position and slides on said cable toward said coupler when moved to said closed position.

23. The apparatus of claim 22, wherein:

said coupler has a stop surface;

said cable has an end with a stop surface;

said removable stop comprises two wall members each having first and second ends for engaging said stop surface of said coupler and said stop surface of said end of said cable respectively for holding said cable and said coupler apart, each of said wall members having two spaced apart edges with said two edges of one of said wall members being adapted to engage said two edges of the other of said wall member respectively to form an enclosed space for receiving said wires.

24. The apparatus of claim 22, wherein:

said coupler has a stop surface;

said cable has an end with a stop surface;

said removable stop comprises a single member having first and second ends for engaging said stop surface of said coupler and said stop surface of said end of said cable respectively for holding said cable and said coupler apart;

said member comprises an enclosing wall with a gap formed through said enclosing wall between said first and second ends defining a cavity for receiving said wires.

25. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve has a first end which engages said coupler when said sleeve is located in said closed position;

said fastening means comprises;

a pin coupled to said coupler;

a curved slot formed in said first end of said sleeve for receiving said pin and fastening said sleeve to said pin and hence to said coupler when said sleeve is rotated in a first direction to locate said pin in said slot at a holding position and for releasing said sleeve from said pin when said sleeve is rotated in a direction opposite said first direction;

said sleeve is slidable on said cable such that said sleeve slides on said cable away from said coupler when moved to said open position and slides on said cable toward said coupler when moved to said closed position;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler, said sleeve is in said closed position, and said pin is located in said slot at said holding position.

26. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position; said sleeve has a first end which engages said coupler when said sleeve is located in said closed position;

said fastening means comprises;

a pin coupled to said coupler;

a curved slot formed in said first end of said sleeve for receiving said pin and fastening said sleeve to said pin and hence to said coupler when said sleeve is rotated in a first direction to locate said pin in said slot at a holding position and for releasing said sleeve from said pin when said sleeve is rotated in a direction opposite said first direction;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said removable stop comprises two wall members each having first and second ends for engaging said stop surface of said coupler and said stop surface of said end of said cable respectively for holding said cable and said coupler apart;

each of said wall members having two spaced apart edges with said two edges of one of said wall members being adapted to engage said two edges of the other of said wall members respectively to form an enclosed spaced for receiving said wires;

said sleeve has a second end opposite said first end and a first opening extending from said first end to said second end;

said second end comprises an inward extending wall which defines a second opening which is smaller than said first opening;

said cable extends through said second opening; said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler, said sleeve is in said closed position, and said pin is located in said slot at said holding position.

27. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve is slidable on said cable such that said sleeve slides on said cable away from said coupler when moved to said open position and slides on said cable toward said coupler when moved to said closed position;

said sleeve has a first end which engages said coupler when said sleeve is located in said closed position;

said fastening means comprises;

a pin coupled to said coupler;

a curved slot formed in said first end of said sleeve for receiving said pin and fastening said sleeve to said pin and hence to said coupler when said sleeve is rotated in a first direction to locate said pin in said slot at a holding position and for releasing said sleeve from said pin when said sleeve is rotated in a direction opposite said first direction;

said coupler has a stop surface;

said stop comprises a single member having first and second ends for engaging said stop surface of said coupler and said stop surface of said end of said cable respectively for holding said cable and said coupler apart;

said member comprises an enclosing wall with a gap formed through said enclosing wall between said first and second ends defining a cavity for receiving said wires;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler, said sleeve is in said closed position and said pin is located in said slot at said holding position.

28. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve has a first end;

said fastening means comprises a first fastening means movably coupled to said coupler and a second fastening means formed on said first end of said sleeve such that said first fastening means can be fastened to and unfastened from said second fastening means when said sleeve is at said closed position;

said sleeve is slidable on said cable such that said sleeve slides on said cable away from said coupler when moved to said open position and slides on said cable toward said coupler when moved to said closed position;

said sleeve has a second end opposite said first end and a first opening extending from said first end to said second end;

said second end comprises an inward extending wall which defines a second opening which is smaller than said first opening;

said cable extend through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said stop engages said cable and said coupler and said sleeve is fastened in said closed position.

29. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

said sleeve has a first end;

fastening means for removably fastening said sleeve in said closed position and for allowing said sleeve to be moved from said closed position to said open position;

said fastening means comprises a first fastening means movable coupled to said coupler and a second fastening means formed on said first end of said sleeve such that said first fastening means can be fastened to and unfastened from said second fastening means when said sleeve is at said closed position;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said removable stop comprises two wall members each having first and second ends for engaging said stop surface of said coupler and said stop surface of said end of said cable respectively for holding said cable and said coupler apart;

each of said wall members having two spaced apart edges with said two edges of one of said wall members being adapted to engage said two edges of the other of said wall members respectively to form an enclosed space for receiving said wires;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler and said sleeve is fastened in said closed position.

30. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

said sleeve has a first end;

fastening means for removably fastening said sleeve in said closed position and for allowing said sleeve to be moved from said closed position to said open position;

said fastening means comprises a first fastening means movable coupled to said coupler and a second fastening means formed on said first end of said sleeve such that said first fastening means can be fastened to and unfastened from said second fastening means when said sleeve is at said closed position;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said removable stop comprises two wall members each having first and second ends for engaging said stop surface of said coupler and said stop surface of said end of said cable respectively for holding said cable and said coupler apart;

each of said wall members having two spaced apart edges with said two edges of one of said wall members being adapted to engage said two edges of the other of said wall members respectively to form an enclosed space for receiving said wires;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler and said sleeve is fastened in said closed position.

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve has a first sleeve end;

said fastening means comprises a first fastening means movably coupled to said coupler and a second fastening means formed on said first sleeve end such that said first fastening means can be fastened to and unfastened from said second fastening means when said sleeve is at said closed position;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said stop comprises a single member having first and second ends for engaging said stop surface of said coupler and said stop surface of said end of said cable respectively for holding said cable and said coupler apart;

said member comprises an enclosing wall with a gap formed through said enclosing wall between said first and second ends of said member defining a cavity for receiving said wires;

said sleeve has a second sleeve end opposite said first sleeve end and a first opening extending from said first sleeve end to said second sleeve end;

said second sleeve end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said sleeve is in said closed position and said sleeve is fastened in said closed position.

31. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires; fastening means for removably fastening said sleeve in said closed position and for allowing said sleeve to be moved from said closed position to said open position; said sleeve has a first end;

said fastening means comprises a first fastening means movably coupled to said coupler and a second fastening means formed on said first end of said sleeve such that said first fastening means can be fastened to and unfastened from said second fastening means when said sleeve is at said closed position;

said sleeve is slidable on said cable such that said sleeve slides on said cable away from said coupler when moved to said open position and slides on said cable toward said coupler when moved to said closed position;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening;

a spring located between said inward extending wall of said sleeve and said outward extending portion of said fitting for applying a force to said sleeve away from said coupler when said stop engages said cable and said coupler and said sleeve is fastened in said closed position;

said second opening of said sleeve has at least one flat surface;

said fitting has at least one flat surface which engages said flat surface of said second opening which prevents said fitting from rotating relative to said sleeve when said sleeve is fastened in said closed position.

32. A connection apparatus, comprising: a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve is slidable on said cable such that said sleeve slides on said cable away from said coupler when moved to said open position and slides on said cable toward said coupler when moved to said closed position;

said sleeve has a first end;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler and said sleeve is fastened in said closed position.

33. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said removable stop comprises two wall members each having first and second ends of engaging said stop surface of said coupler and said stop surface of said end of said cable respectively for holding said cable and said coupler apart;

each of said wall members having two spaced apart edges with said two edges of one of said wall members being adapted to engage said two edges of the other of said wall members respectively to form an enclosed space for receiving said wires;

said sleeve has a first sleeve end;

said sleeve has a second sleeve end opposite said first sleeve end and a first opening extending from said first sleeve end to said second sleeve end;

said second sleeve end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler and said sleeve is fastened in said closed position.

34. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve is slidable on said cable such that said sleeve slides on said cable away from said coupler when moved to said open position and slides on said cable toward said coupler when moved to said closed position;

said coupler has a stop surface;

said cable has an end with a stop surface;

said removable stop comprises a single member having first and second ends for engaging said stop surface of said coupler and said stop surface of said end of said cable respectively for holding said cable and said coupler apart;

said member comprises an enclosing wall with a gap formed through is enclosing wall between said first and second ends defining a cavity for receiving said wires;

said sleeve has a first end;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said sleeve is in said closed position and said sleeve is fastened in said closed position.

35. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve engages said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said sleeve is slidable on said cable such that said sleeve slides on said cable away from said coupler when moved to said open position and slides on said cable toward said coupler when moved to said closed position;

said sleeve has a first end;

said sleeve has a second end opposite said first end and a first opening extending from said first end to said second end;

said second end comprises an inward extending wall which defines a second opening which is smaller than said first opening;

said cable extends through said second opening;

said cable has a fitting coupled thereto with an outward extending portion located in said first opening and which cannot pass through said second opening; and a spring located between said inward extending wall of said sleeve and said outward extending portion of said fitting for applying a force to said sleeve away from said coupler when said removable stop engages said cable and said coupler and said sleeve is fastened in said closed position;

said second opening of said sleeve has at least one flat surface;

said fitting has at least one flat surface which engages said flat surface of said second opening which prevents said fitting from rotating relative to said sleeve when said sleeve is fastened in said closed position.

36. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve is coupled to said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said fastening means comprises a first fastening means coupled to said coupler and a second fastening means formed on said first end of said sleeve such that said first fastening means can be fastened to and unfastened from said second fastening means when said sleeve is at said closed position;

said coupler has a central axis;

said first fastening means comprises a spring member normally biased toward said axis;

said second fastening means comprises a slot formed in the exterior of said sleeve for receiving said spring member when said sleeve is in said closed position for holding said sleeve in said closed position; and movable means for moving said spring member out of said slot to allow said sleeve to be moved to said open position.

37. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve is coupled to said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said fastening means comprises a first fastening means coupled to said coupler and a second fastening means formed on said first end of said sleeves such that said first fastening means can be fastened to and unfastened from said second fastening means when said sleeve is at said closed position;

said coupler has a central axis;

said first fastening means comprises a spring member normally biased outward of said axis and having outward facing teeth;

said second fastening means comprises inward facing teeth formed on said sleeve for engaging said outward facing teeth of said second fastening means when said sleeve is in said closed position for holding said sleeve in said closed position;

said outward facing teeth of said second fastening means being movable inwardly to allow said sleeve to be moved to said open position.

38. A connection apparatus, comprising:

a cable and a coupler, wherein electrical wires extend between said cable and said coupler;

a removable stop adapted to engage said cable and said coupler to hold said cable and said coupler apart to form a gap therebetween wherein said electrical wires extend between said cable and said coupler by way of said gap;

a sleeve movable relative to said cable and said coupler, between a closed position wherein said sleeve is coupled to said cable and said coupler and surrounds said wires and said removable stop, and an open position to allow said removable stop to be removed to provide access to said wires;

fastening means for removably fastening said sleeve in said closed position and for allowing said sleeve to be moved from said closed position to said open position;

said fastening means comprises a first fastening means coupled to said coupler and a second fastening means formed on said first end of said sleeve such that said first fastening means can be fastened to and unfastened from said second fastening means when said sleeve is at said closed position;

said coupler has a central axis;

an annular wall coupled to said coupler and having at least one aperture formed therethrough for holding a ball;

said first fastening means comprises an annular cover supported for movement along said axis, normally biased in a first direction to locate said cover in a first position;

said annular cover having an outer slot facing said axis;

said second fastening means comprises an inner slot formed in the exterior of said sleeve for partially receiving said ball for holding said sleeve in said closed position when said first fastening means is located in said first position;

said annular cover being movable in a direction opposite said first direction to align said outer slot with said aperture for partially receiving said ball to allow said sleeve to be moved to said open position.

39. A connection apparatus, comprising:

a cable and a coupler wherein electrical wires extend from said cable and are connected by wire connections to electrical wires extending from said coupler;

removable wall means defining a cavity for receiving said wires and said wire connections;

said wall means has opposite ends with one of said ends engaging said cable and the other of said ends engaging said coupler for holding said cable and said coupler apart with said wires and said wire connections located in said cavity of said wall means;

a sleeve located around said wall means and releasably coupled to said cable and to said coupler with said wall means including said opposite ends located within said sleeve such that said sleeve may be uncoupled from said coupler and moved away from said coupler to allow said wall means to be removed to provide access to said wires and said wire connections.

40. A connection apparatus, comprising:

a cable and a coupler, wherein electrical wires extend between said cable and said coupler;

a removable stop engaging said cable and said coupler for holding said cable and said coupler apart to form a gap therebetween wherein said electrical wires extend between said cable and said coupler by way of said gap;

a sleeve located in a closed position wherein said sleeve engages said cable and said coupler and surrounds said wires and said removable stop, said sleeve being movable to an open position away from said coupler to allow said removable stop to be removed to provide access to said wires; and fastening means for removably fastening said sleeve in said closed position and for allowing said sleeve to be moved from said closed position to said open position.

* * * * *